US009301612B2

(12) United States Patent
Kaloustian et al.

(10) Patent No.: US 9,301,612 B2
(45) Date of Patent: Apr. 5, 2016

(54) CHAIR WITH A SWIVEL BACK SUPPORT

(71) Applicant: Grand Rapids Chair Company, Grand Rapids, MI (US)

(72) Inventors: John M. Kaloustian, Northville, MI (US); Ryan E. Haase, Grand Rapids, MI (US)

(73) Assignee: Grand Rapids Chair Company, Grand Rapids, MI (US)

( * ) Notice: Subject to any disclaimer, the term of this patent is extended or adjusted under 35 U.S.C. 154(b) by 248 days.

(21) Appl. No.: 13/966,374

(22) Filed: Aug. 14, 2013

(65) Prior Publication Data

US 2014/0361593 A1 Dec. 11, 2014

Related U.S. Application Data

(63) Continuation-in-part of application No. 29/457,431, filed on Jun. 10, 2013, now Pat. No. Des. 723,826.

(51) Int. Cl.
*A47C 3/04* (2006.01)
*A47C 7/00* (2006.01)

(52) U.S. Cl.
CPC .. *A47C 3/04* (2013.01); *A47C 7/006* (2013.01)

(58) Field of Classification Search
CPC ..... A47C 3/04; A47C 7/006
USPC ..... 297/354.11, 440.22, 440.23
See application file for complete search history.

(56) References Cited

U.S. PATENT DOCUMENTS

D193,657 S 9/1962 Van Buren
D197,643 S 3/1964 Kramer
D202,549 S 10/1965 Kramer
D202,550 S 10/1965 Kramer
D223,244 S 4/1972 Prashker
3,751,109 A * 8/1973 Dufton ..... 297/440.22
D239,988 S 5/1976 Dittert
D240,780 S 8/1976 Dittert
4,032,190 A 6/1977 Muller-Deisig et al.
D255,183 S 6/1980 Locher
D255,293 S 6/1980 Locher
4,316,632 A * 2/1982 Brauning ..... 297/291
D268,799 S 5/1983 Feldberg
D272,393 S 1/1984 Klier
D279,155 S 6/1985 Aronowitz et al.
D307,221 S 4/1990 Mudge
D339,940 S 10/1993 Balderi et al.
D346,911 S 5/1994 Lucci et al.
D372,132 S 7/1996 Infanti
D375,848 S 11/1996 Grosfillex
5,649,739 A * 7/1997 Zapf ..... 297/354.11 X (Continued)

OTHER PUBLICATIONS

Commonly assigned U.S. Appl. No. 29/454,332, filed May 9, 2013, entitled Chair and Ottoman.

(Continued)

*Primary Examiner* — Anthony D Barfield
(74) *Attorney, Agent, or Firm* — Gardner, Linn, Burkhart & Flory, LLP

(57) ABSTRACT

A chair includes a unitary shell defining a seat portion and a riser portion. The riser portion is generally normal to the seat portion. The chair further includes a back support and a flexible coupling that couples a portion of the back support to a portion of the riser portion. The flexible coupling includes a cushion between the portion of the back support and the portion of the riser portion.

24 Claims, 8 Drawing Sheets

(56) References Cited

U.S. PATENT DOCUMENTS

| | | | | |
|---|---|---|---|---|
| D381,828 | S | 8/1997 | Kemnitzer | |
| 5,887,946 | A * | 3/1999 | Raftery | 297/354.11 X |
| D422,806 | S | 4/2000 | Neil | |
| 6,270,162 | B1 * | 8/2001 | Jeny | 297/440.22 X |
| D512,236 | S | 12/2005 | Preisig | |
| D512,238 | S | 12/2005 | Chen | |
| D524,071 | S | 7/2006 | Brooks | |
| D531,420 | S | 11/2006 | Kita | |
| D544,228 | S | 6/2007 | Bartlmae | |
| D559,570 | S | 1/2008 | Higgs et al. | |
| D572,049 | S | 7/2008 | Kerr | |
| D597,757 | S | 8/2009 | Barbieri | |
| D611,740 | S | 3/2010 | Koh | |
| D643,652 | S | 8/2011 | Piretti | |
| D644,849 | S | 9/2011 | Sienkowski et al. | |
| D646,087 | S | 10/2011 | Miller et al. | |
| D648,566 | S | 11/2011 | Sienkowski et al. | |
| 8,112,868 | B2 | 2/2012 | Miller | |
| D659,424 | S | 5/2012 | Gramza et al. | |
| D659,444 | S | 5/2012 | James | |
| D663,131 | S | 7/2012 | Barefoot et al. | |
| D672,975 | S | 12/2012 | Rashid | |
| D683,558 | S | 6/2013 | Rada et al. | |
| 2009/0212607 | A1 | 8/2009 | Kaloustian et al. | |
| 2011/0278889 | A1 | 11/2011 | Sienkowski et al. | |

OTHER PUBLICATIONS

Commonly assigned U.S. Appl. No. 29/457,431, filed Jun. 10, 2013, entitled Chair.

* cited by examiner

CHAIR WITH A SWIVEL BACK SUPPORT

CROSS-REFERENCE TO RELATED APPLICATIONS

This is a continuation-in-part application of U.S. design patent application Ser. No. 29/457,431, filed on Jun. 10, 2013, the disclosure of which is hereby incorporated herein by reference.

BACKGROUND OF THE INVENTION

The present invention is directed to a chair having a swivel back. While the invention is useful with various applications, it is particularly useful with chairs that are stackable or nestable.

Chairs with a swivel back are capable of obtaining a comfortable sitting position as the chair self-adjusts to the back of the user. It is also necessary for the chair to be rugged especially for use in a commercial setting, such as an office environment, restaurant, educational or other application where rugged use is expected. These requirements are often contradictory to attempting to provide a chair that is relatively light in weight, comfortable to sit in and attractive in appearance. Also, it is desirable to be able to meet these requirements in a chair that is stackable or nestable for ease of storage.

SUMMARY OF THE INVENTION

A chair, according to an aspect of the invention, includes a unitary shell defining a seat portion and a riser portion. The riser portion is generally normal to the seat portion. The chair further includes a back support and a flexible coupling that couples a portion of the back support to a portion of the riser portion.

The flexible coupling may include a cushion between the portion of the back support and the portion of the riser portion. The flexible coupling may further include a fastener extending through the portion of the back member, the cushion and the portion of the riser portion respectively. The fastener may include a nut at one of said back members and said riser portion and a threaded bolt having a head at the other of said back members and said riser portion. The nut may be a T-nut and a decorative panel secured to the T-nut.

The back support may be spaced forward of the riser portion. A void may be defined between the riser portion and back member as viewed from a seated location. The portion of the riser portion may include two spaced apart attachment ears at which the flexible coupling is positioned thereby defining the void between said ears. The shell may be made from a single piece of wood. The piece of wood may be a piece of laminated wood. The seat portion, the riser portion and the back support may each be generally concave in shape. The chair may be stackable or nestable.

A chair, according to another aspect of the invention, includes a unitary shell defining a seat portion and a riser portion, with the riser portion being generally normal to the seat portion. The chair further includes a back support and a flexible coupling that couples the back support to the riser portion with the back support extending forward of the riser portion with a void defined between the riser portion and the back support when viewed from a seated location. A leg assembly is attached to the shell to support the shell.

The shell may be made of a single piece of laminated wood. At least one spacer may be provided between the leg assembly and the shell. The at least one spacer may be a plurality of spacers and a plurality of screws may be provided to fasten the leg assembly to said shell wherein said screws may each extend into one of the spacers. An arm assembly may be attached to the leg assembly. The chair may be stackable or nestable.

The flexible coupling may include a cushion between the back support and riser portion. The flexible coupling may include a fastener extending through the back support, the cushion and the riser portion, respectively. The fastener may include a nut at one of the back supports and riser portion and a threaded bolt having a head at the other of the back supports and riser portion. The nut may be a T-nut and a decorative panel secured to the T-nut.

A void may be defined between the riser portion and back support as viewed from a seated position. The riser portion may include two spaced apart attachment ears at which the flexible coupling is positioned thereby defining the void between the ears. The seat, the riser portion and the back support may each be concave.

These and other objects, advantages and features of this invention will become apparent upon review of the following specification in conjunction with the drawings.

DESCRIPTION OF THE PREFERRED EMBODIMENT

Figure 1:
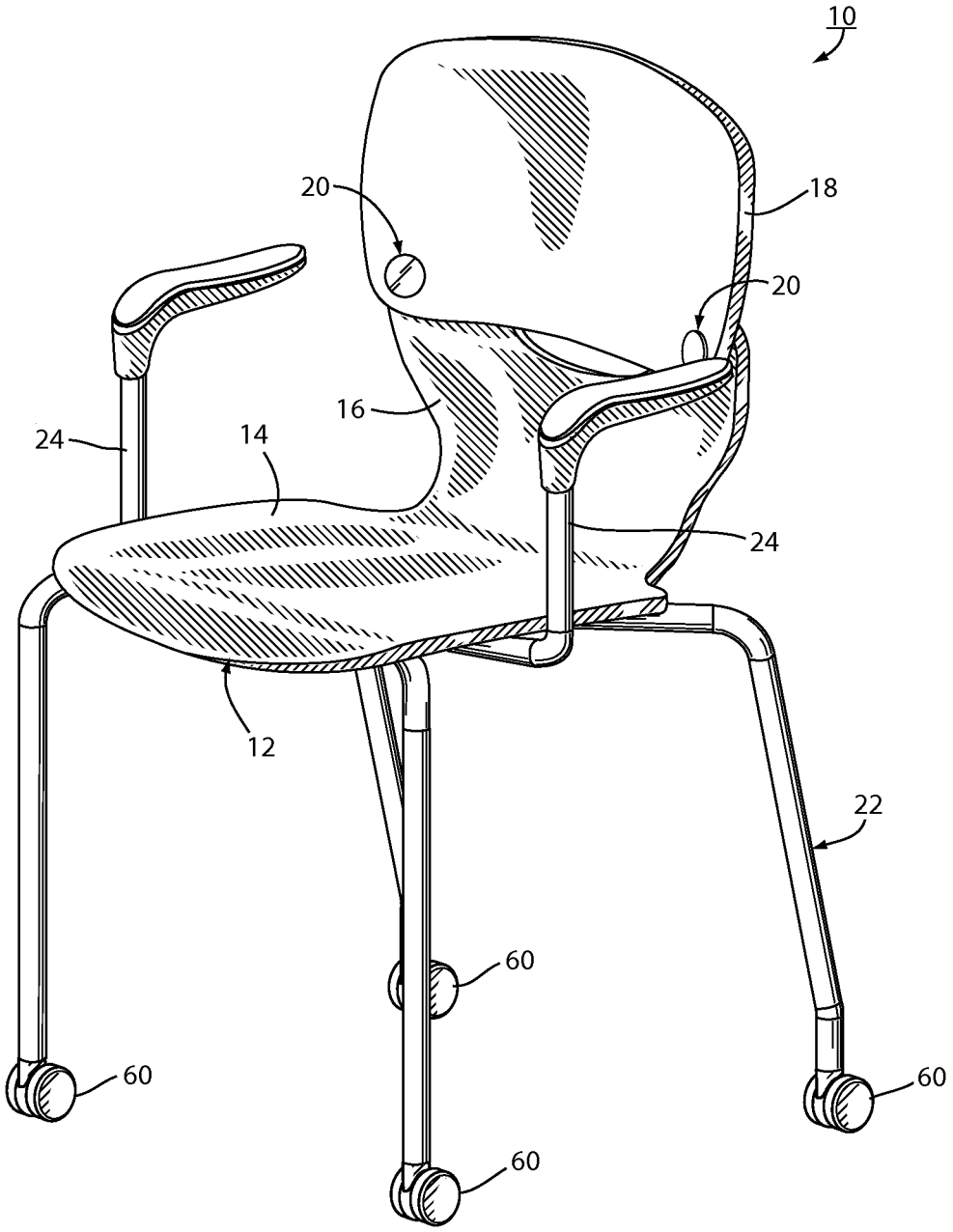
FIG. 1 is a perspective view taken from the front, top and right side of a chair, according to an embodiment of the invention.

Referring now to the drawings and the illustrative embodiments depicted therein, a chair 10 includes a unitary shell 12 that forms seat portion 14 and a riser portion 16 that is generally normal, or perpendicular, to seat portion 14. Seat portion 14 is generally concave to provide comfortable support to a human. The chair further includes a back support 18 that is generally configured to a portion of a human back and swivels with respect to seat portion 14. This allows the back support 18 to self-adjust to a comfortable position under the pressure exerted by a sitting human. Back support 18 is mounted forward of riser portion 16 thereby accommodating contours of a human buttocks forward of riser portion 16 while providing adequate support to the user's back. To conform to a human back, back support 18 is generally concave in shape. A pair of flexible couplings 20 couple back support 18 to riser portion 16 with back support 18 extending forward of riser portion 16. A leg assembly 22 supports shell 12. An optional pair of arm assemblies are attached directly to leg assembly 22 thereby reducing stress applied to shell 12.

Each flexible coupling 20 includes a cushion 26 between back support 18 and riser portion 16. Cushion 26 both accommodates movement of back support 18 with respect to seat portion 14 and provides a bias tending to return back support 18 to a neutral position that is generally parallel to riser portion 16. This is accomplished by making cushion 26 from a relatively firm yet flexible polymeric material with a relatively high durometer value as would be understood by the skilled artisan. Flexible coupling 20 further includes a fastener 28 extending through back support 18, cushion 26 and riser portion 16 in that order. Fastener 18 includes a nut 30 at the back support and a threaded bolt 31 having a head at the riser portion, or vice versa. Nut 30 may be a T-nut, known in the art that is pressed into an opening 40 in the back support. A decorative panel 32 is secured to T-nut 30, such as by adhesive or welding. A washer 34 is provided between the head of bolt 31 and riser portion 16 if the bolt head is relatively small.

Figure 2:
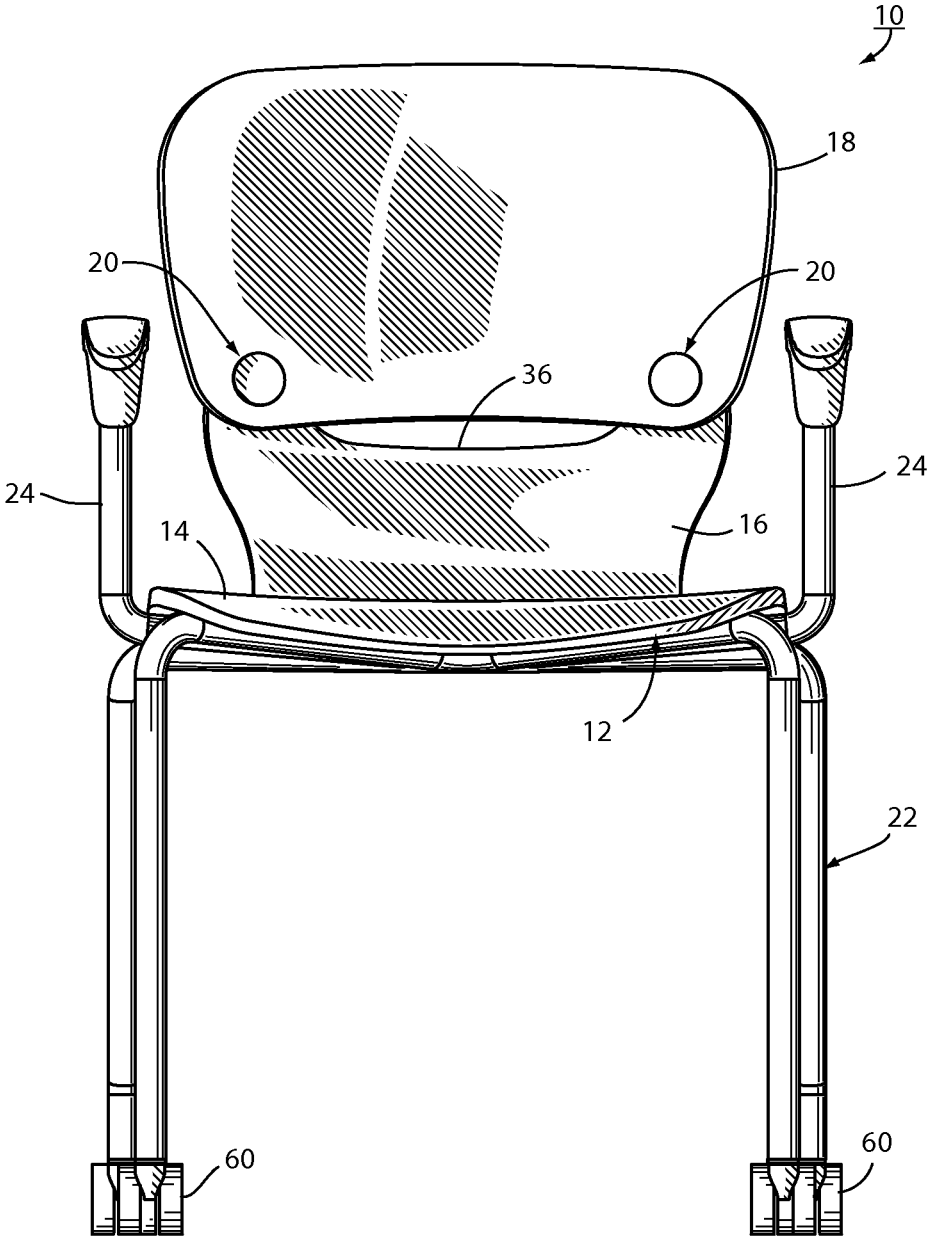
FIG. 2 is a front elevation view of the chair in FIG. 1.
Figure 3:
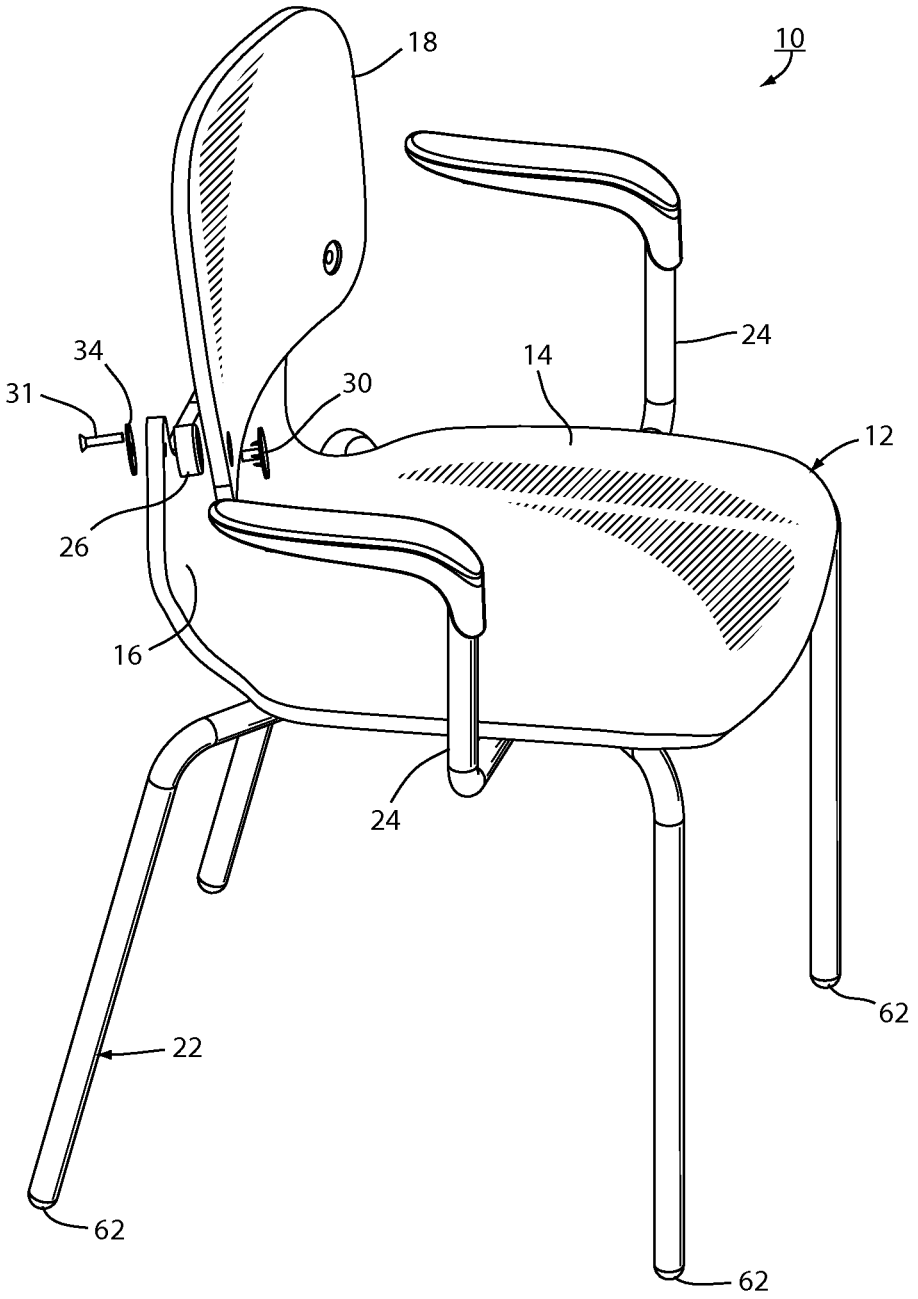
FIG. 3 is a partial exploded perspective view taken from the front, top and left side of the chair in FIG. 1, showing details of the back mounting.
Figure 4:
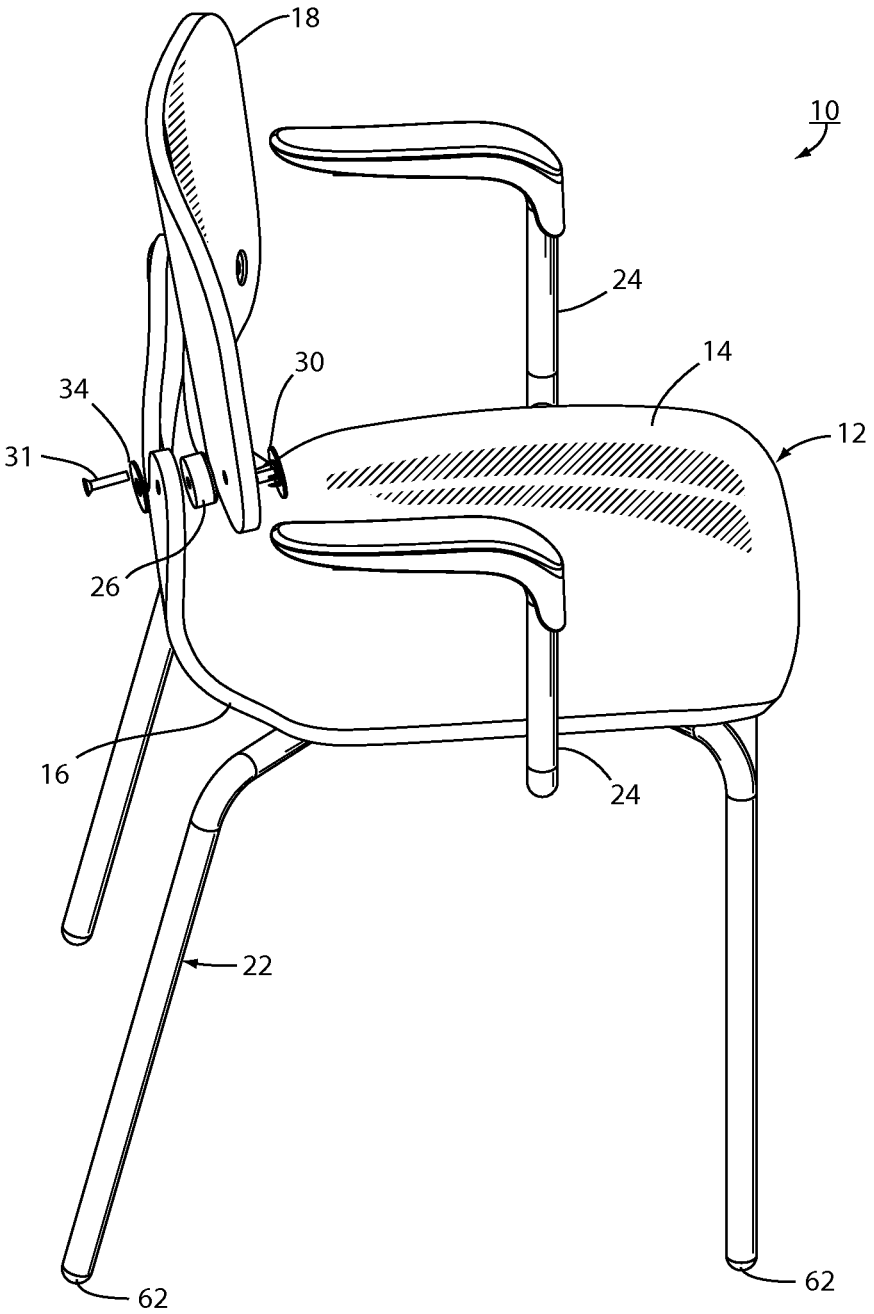
FIG. 4 is the same view as FIG. 3 taken from the top and left side thereof.
Figure 5:
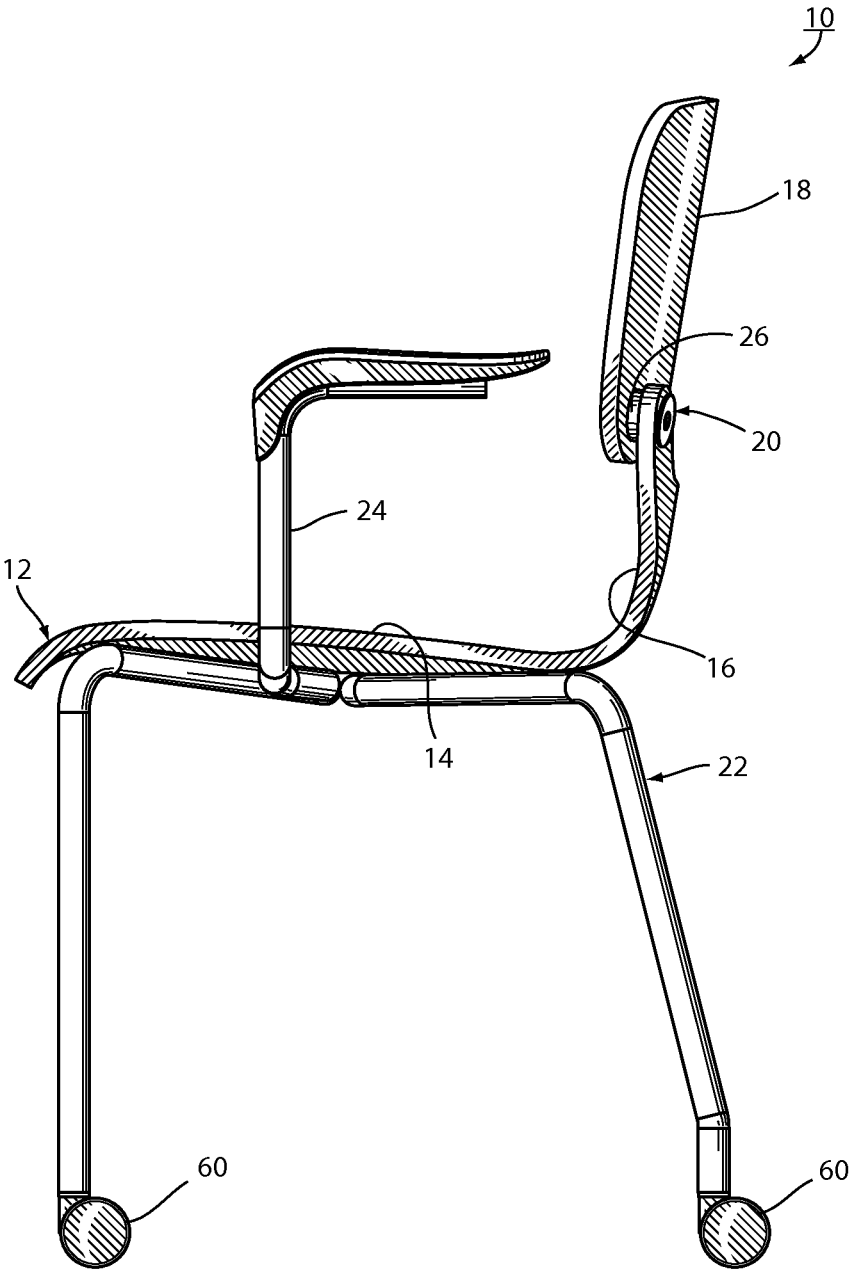
FIG. 5 is a left side elevation view of the chair in FIG. 1.
Figure 6:
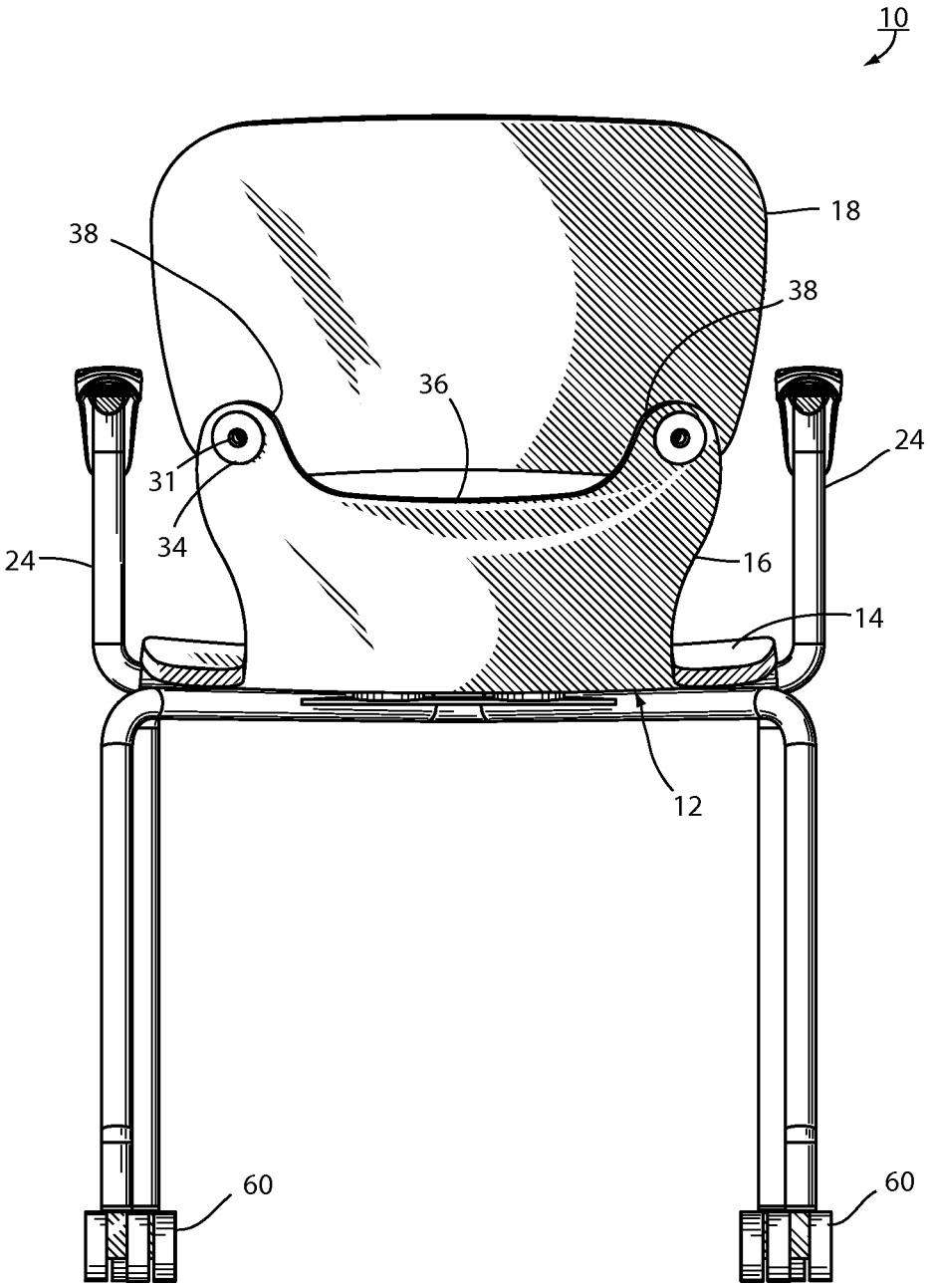
FIG. 6 is a rear elevation view of the chair in FIG. 1.

A void 36 is defined between an upper edge of riser portion 16 and lower edge of back support 18 as viewed from a seated location, as seen in FIG. 2, forward of back portion 18. Void 36 helps to avoid any pinch-points for the user's skin as back support 18 pivots. Riser portion 16 includes two spaced apart attachment ears 38 at which flexible coupling 20 is positioned thereby accommodating void 36 while still supporting back support 18.

Shell 12 is formed of a single piece of wood or other material. In the illustrated embodiment, shell 12 is formed from a piece of laminated wood. In a similar fashion, back support 18 is formed of a single piece of wood or other material and, in the illustrated embodiment, is formed from a piece of laminated wood. Seat portion 14, riser portion 16 and back support 18 are each generally concave in shape.

Figure 7:
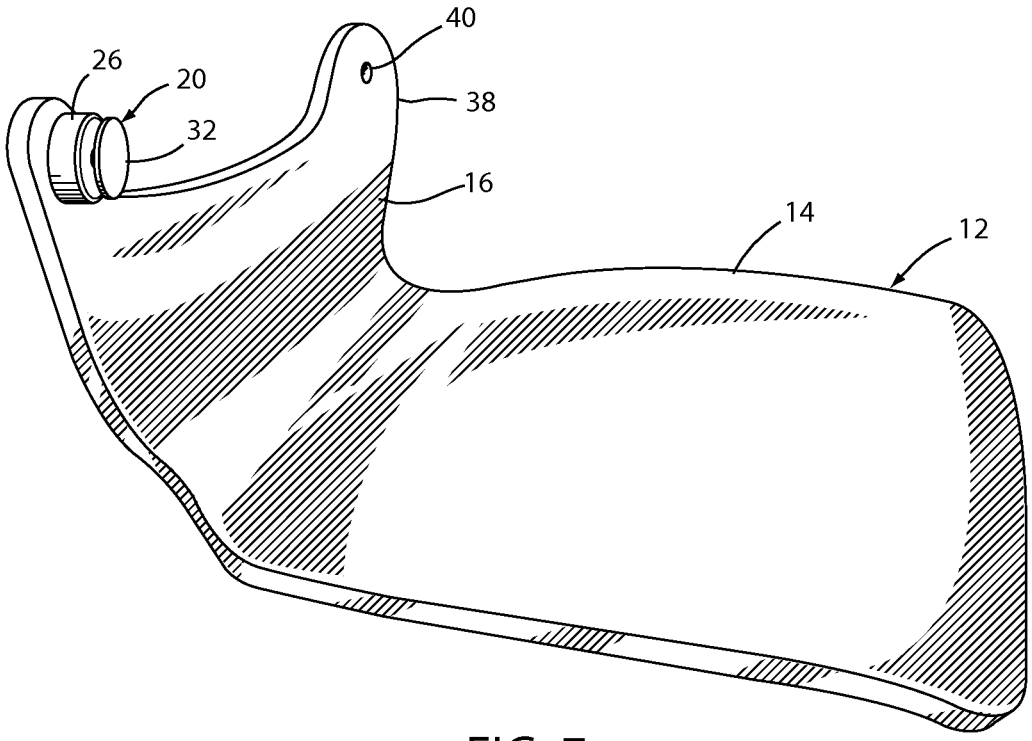
FIG. 7 is a perspective view taken from the front, top and left side of a chair shell with one flexible coupling shown.
Figure 8:
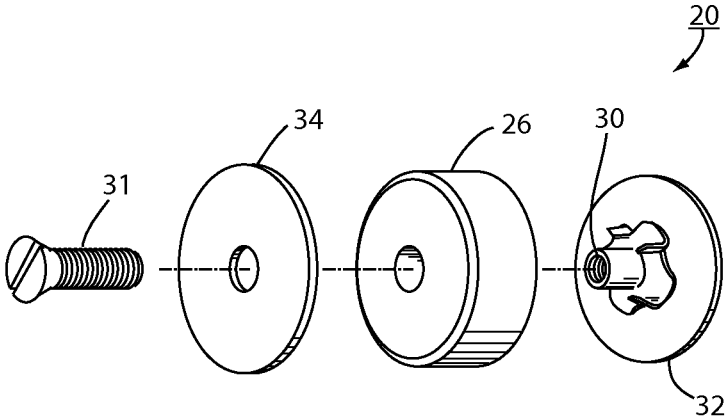
FIG. 8 is an exploded perspective view of a flexible coupling.
Figure 9:
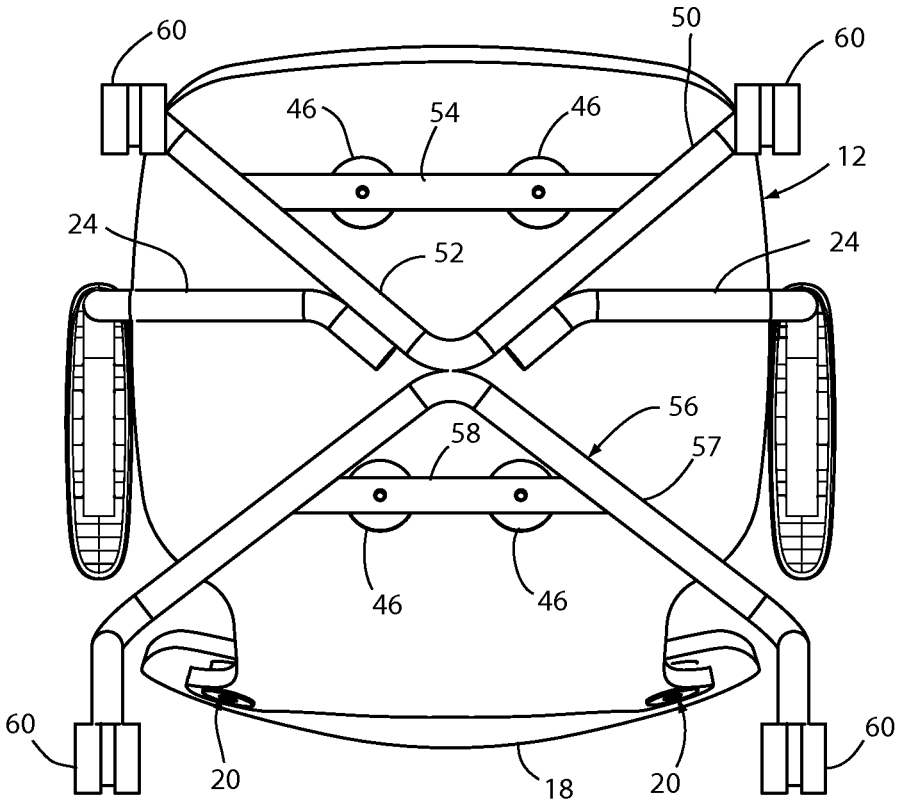
FIG. 9 is a bottom plan view of the chair in FIG. 1.

Leg assembly 22 is attached to shell 12 to support the shell as best seen in FIG. 7. Leg assembly 22 is an integral assembly made up of a front frame portion 50 formed of a U-shaped tube with supporting cross member 54 and a rear frame portion 56 made up of a U-shaped tube 57 and cross member 58. At least one spacer 46 is provided between leg assembly 22 and shell 12. In the illustrated embodiment, a plurality of spacers 46, namely four, are provided between cross members 54, 58 and the shell and a plurality of screws 47 fasten leg assembly 22 to shell 12 with the screws each passing into one of the spacers which are fixed to shell 12. Each arm assembly 24 is separately attached to leg assembly 22 although the arm assemblies could be a unitary structure that is attached to leg assembly 22.

Chair 10 not only provides for a swivel back support, but is stackable or nestable. Optionally, casters 60 or glides may be provided to interface with a floor surface. Chair 10 may be supplied with bare surfaces as illustrated. Alternatively, the seat portion and/or back support may be padded or upholstered.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments.

The embodiments of the invention in which an exclusive property or privilege is claimed are defined as follows:

1. A chair, comprising:

a unitary shell defining a seat portion and a riser portion, said riser portion being generally normal to said seat portion;

a back support; and a flexible coupling that couples a portion of said back support to a portion of said riser portion;

wherein said flexible coupling comprises a cushion between said portion of said back support and said portion of said riser portion. and a fastener extending through said back support, said cushion, and said riser portion.

2. The chair as claimed in claim 1 wherein said fastener comprises a nut at one of said back support and said riser portion and a threaded bolt having a head at the other of said back support and said riser portion.

3. The chair as claimed in claim 2 wherein said nut comprises a T-nut and a decorative panel secured to said T-nut.

4. The chair as claimed in claim 1 wherein said back support is spaced forward of said riser portion.

5. The chair as claimed in claim 4 including a void defined between said riser portion and said back support as viewed from a seated location.

6. The chair as claimed in claim 5 wherein said portion of said riser portion comprises two spaced apart attachment ears at which said flexible coupling is positioned thereby defining said void between said ears.

7. The chair as claimed in claim 1 wherein said shell is made of a single piece of wood.

8. The chair as claimed in claim 7 wherein said piece of wood comprises a piece of laminated wood.

9. The chair as claimed in claim 1 wherein said seat portion, said riser portion and said back support are each generally concave in shape.

10. The chair as claimed in claim 1 that is stackable or nestable.

11. A chair, comprising:

a unitary shell defining a seat portion and a riser portion, said riser portion being generally normal to said seat portion;

a back support;

a flexible coupling that couples said back support to said riser portion with said back support overlapping and coupled forward of said riser portion with a void defined between said riser portion and said back support when viewed from a seated location; and a leg assembly attached to said shell to support said shell.

12. The chair as claimed in claim 11 wherein said shell is made of a single piece of laminated wood.

13. The chair as claimed in claim 11 including at least one spacer between said leg assembly and said shell.

14. The chair as claimed in claim 13 wherein said at least one spacer comprises a plurality of spacers.

15. The chair as claimed in claim 14 including a plurality of screws fastening said leg assembly to said shell, wherein said screws each pass into one of said spacers.

16. The chair as claimed in claim 11 including an arm assembly attached to said leg assembly.

17. The chair as claimed in claim 16 that is stackable or nestable.

18. The chair as claimed in claim 11 wherein said flexible coupling comprises a cushion between said back support and said riser portion.

19. The chair as claimed in claim 18 wherein said flexible coupling comprises a fastener extending through said back support, said cushion and said riser portion, respectively.

20. The chair as claimed in claim 19 wherein said fastener comprises a nut at one of said back support and said riser portion and a threaded bolt having a head at the other of said back support and said riser portion.

21. The chair as claimed in claim 20 wherein said nut comprises a T-nut and a decorative panel secured to said T-nut.

22. The chair as claimed in claim 11 including a void defined between said riser portion and said back support as viewed from a seated position, and between at least two of said flexible couplings.

23. The chair as claimed in claim 22 wherein said riser portion comprises two spaced apart attachment ears at which said flexible couplings are positioned thereby defining said void between said ears.

24. The chair as claimed in claim 11 wherein said seat, said riser portion and said back support each being concave.

* * * * *